US009206653B2

(12) United States Patent
Essel et al.

(10) Patent No.: US 9,206,653 B2
(45) Date of Patent: Dec. 8, 2015

(54) DEVICE FOR UNCOUPLING A DRILL STRING, DRILLING SYSTEM COMPRISING SUCH A UNCOUPLING DEVICE, AND USE OF SUCH A SYSTEM

(75) Inventors: Philippe Essel, Pau (FR); Jean-Marc Loriot, Paris (FR); Christian Salesse, Laroche pres Feyt (FR); Sebastian Desmette, Gosselies (BE)

(73) Assignees: Jean-Marc Loriot, Paris (FR); Christian Salesse, Laroche pres Feyt (FR)

( * ) Notice: Subject to any disclaimer, the term of this patent is extended or adjusted under 35 U.S.C. 154(b) by 761 days.

(21) Appl. No.: 13/574,067

(22) PCT Filed: Jan. 14, 2011

(86) PCT No.: PCT/FR2011/050071

§ 371 (c)(1),
(2), (4) Date: Oct. 24, 2012

(87) PCT Pub. No.: WO2011/089346

PCT Pub. Date: Jul. 28, 2011

(65) Prior Publication Data

US 2013/0037326 A1 Feb. 14, 2013

(30) Foreign Application Priority Data

Jan. 20, 2010 (FR) ..... 10 50372

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS

| | | | |
|---|---|---|---|
| 4,186,569 | A | 2/1980 | Aumann |
| 4,281,726 | A | 8/1981 | Garrett |

FOREIGN PATENT DOCUMENTS

| | | |
|---|---|---|
| EP | 0 054 091 | 6/1982 |
| WO | 2009 135248 | 11/2009 |

OTHER PUBLICATIONS

International Search Report Issued May 3, 2011 in PCT/FR11/50071 Filed Jan. 14, 2011.

*Primary Examiner* — David Andrews
(74) *Attorney, Agent, or Firm* — Oblon, McClelland, Maier & Neustadt, L.L.P.

(57) ABSTRACT

A device for uncoupling a drill string, the device including, in a longitudinal direction: a first structure that is intended to be attached to a drill string tube; a second structure that is intended to hold a cutting tool for drilling and is translatable relative to the first structure; and a thruster assembly between the first structure and the second structure. The thruster assembly is configured to exert a thrusting force on the second structure to separate the second structure from the first structure, the thrusting force being constant for every position of the second structure relative to the first structure.

16 Claims, 6 Drawing Sheets

DEVICE FOR UNCOUPLING A DRILL STRING, DRILLING SYSTEM COMPRISING SUCH A UNCOUPLING DEVICE, AND USE OF SUCH A SYSTEM

The present invention relates to an uncoupling device for a drill string, to a drilling system comprising such an uncoupling device, and to the use of such a system.

One application of such an uncoupling device is in the drilling of wells, such as wells for the production of petroleum oil. In this application, the uncoupling device is placed, for example, at the bottom of the well, between a cutting tool and tubes of a drill string. During drilling of the well, an operator operates, for example, a brake at the well head in order to control the descent of the drill string. The cutting tool, resting at the bottom of the well on the geological formation, then takes up only a small portion of the weight of the tubes of the drill string.

However, when the cutting tool attacks a rock which is very much harder than the general hardness of the geological formation, it is then subject to a very considerable reaction force in a longitudinal direction towards the head of the well. The repetition of these extreme reaction forces causes wear of the cutting tool. Changing of the cutting tool is time consuming and very expensive, however.

It is an object of the present invention to avoid the cutting tool's being subject to high reaction forces in the longitudinal direction of the drilling well.

An uncoupling device for a drill string according to an embodiment of the invention comprises in a longitudinal direction:

a first structure which is to be fixed to a tube of a drill string, a second structure which is to hold a cutting tool for drilling, said second structure being movable in translation relative to the first structure in the longitudinal direction, said uncoupling device being characterised in that it further comprises a thruster assembly between said first structure and said second structure, said thruster assembly being suitable for exerting a thrusting force on said second structure in order to separate said second structure from said first structure, said thrusting force being substantially constant for every position of the second structure relative to the first structure.

Owing to those provisions, the uncoupling device retracts when it receives a reaction force greater than the thrusting force. Accordingly, the cutting tool moves in the direction of the uncoupling device, moving away from the well bottom slightly, contact between the cutting tool and the geological formation is reduced, and the reaction force on the cutting tool is diminished. In that manner, the reaction force of the geological formation on the cutting tool is self-regulated by the uncoupling device. The cutting tool no longer undergoes a repeated extreme reaction force and becomes worn less quickly.

Furthermore, the uncoupling device has the effect of filtering the vibrations coming from the drill string to the cutting tool and, vice versa, coming from the cutting tool to the drill string. The drill string and the drilling system as a whole is then subject to fewer parasitic vibrations, which also facilitates control of the drilling of the well.

Moreover, because the thrusting force of the uncoupling device is constant over a wide range of displacement of the second structure relative to the first structure, between the first position and the second position, the uncoupling device has a very low intrinsic stiffness. Accordingly, the weight of the cutting tool suspended by the uncoupling device does not itself cause a resonance mode which would amplify the vibrations of the drilling system.

In various embodiments of the uncoupling device for a drill string according to the invention, use may further be made of any of the following provisions:

the second structure is guided in translation relative to the first structure in the longitudinal direction, and the thruster assembly comprises at least one counterbalancing mechanism comprising a resilient member and an output arm, the resilient member producing a resilient force proportional to a compression of the resilient member, the output arm being connected to said resilient member and being capable of pivoting about an output shaft, and a linking means between said output arm and said second structure for applying said thrusting force to said second structure in said longitudinal direction, said linking means comprising a wheel which is articulated for rotation relative to the output arm, at a distance from said output shaft, and rests against a linking surface which is connected to the second structure and is substantially perpendicular to the longitudinal direction;

the counterbalancing mechanism further comprises:

a movable member which is displaceable according to the compression of the resilient member, an input arm which is articulated for rotation about an input shaft and comprises an end portion in contact with a surface of the movable member, said input arm being inclined at a first angle relative to a direction perpendicular to the longitudinal direction, an input gear which is integral with said input arm, and an output gear which is integral with the output arm and in engagement with said input gear, and the output arm being inclined at a second angle relative to the longitudinal direction, said second angle being twice said first angle;

the movable member is displaceable in translation in the longitudinal direction and is capable of tilting according to a tilt angle relative to said longitudinal direction;

the input and output gears have the shape of a segment in order to reduce the space requirement of the counterbalancing mechanism;

the thruster assembly comprises first and second counterbalancing mechanisms, each counterbalancing mechanism comprising an output shaft, the output shafts being disposed offset relative to one another in the longitudinal direction in order to reduce a radial distance perpendicular to the longitudinal direction between said output shafts and to reduce a radial space requirement perpendicular to the longitudinal direction of the thruster assembly;

the input gears of the first and second counterbalancing mechanisms are in engagement with one another;

the thruster assembly comprises a plurality of modules mounted one behind the other in the longitudinal direction between the first structure and the second structure, each module supplying part of the thrusting force on said second structure so that the sum of said parts of the thrusting force of the modules is equal to the thrusting force of the thruster assembly;

the modules of the plurality are identical, each module supplying an identical part of the thrusting force;

the thruster assembly comprises at least one tension rod which passes through all the modules in the longitudinal direction and is suitable for attaching the modules to the first structure, and each module comprises at least one thrust rod suitable for receiving said part of the thrusting force, the thrust rod of one module being suitable for pushing the thrust rod of the following module or for pushing the second structure with the thrusting force;

each module comprises an expansion means suitable for attaching the module to an outer tube which is integral with the first structure;

a resilient element is housed between each thrust rod and the following thrust rod;

each module comprises an inner tube portion and an outer tube portion surrounding the inner tube portion, and in which:

the outer tube portions are attached one behind the other and to the first structure, the inner tube portions are attached one behind the other and to the second structure, and each module supplies said part of the force the inner tube portion of said module;

the thruster assembly is housed in an annular space which extends radially between an inner tube, which is to carry at least one fluid inside said inner tube, and an outer tube, which is attached to the first structure and surrounds said thruster assembly;

elements of the thruster assembly are assembled integrally with one another by banding, then pinning after banding, in order to be able to withstand mechanical stresses acting upon said assembled elements.

The invention relates also to a drilling system comprising an uncoupling device as mentioned above, and further comprising:

a drill string comprising at least one tube, said drill string being connected to the first structure of the uncoupling device, a cutting tool which is to drill a geological formation, the cutting tool being connected to the second structure of the uncoupling device, and a device for holding the drill string at the head of the drilling well, which holding device is suitable for controlling the descent and ascent of the drill string in the drilling well.

In various embodiments of the drilling system according to the invention, use may further be made of any of the following provisions:

the uncoupling device comprises at least one displacement sensor for determining a position of the second structure relative to the first structure, and the system comprises a transmission means for transmitting said position to the holding device for controlling a holding force of the drill string;

the holding force of the drill string is increased if the position indicates that the second structure is close to the first structure, and the holding force of the drill string is reduced if the position indicates that the second structure is remote from the first structure.

The invention relates also to the use of the drilling system as mentioned above, and in which:

a holding force of the drill string is defined, said holding force being kept constant, a predetermined distance of the geological formation is drilled, said distance being smaller than a stroke of the uncoupling device, an angle corresponding to the angular rotation of the cutting tool for drilling said predetermined distance is measured, and the depth of cut for said geological formation is determined by means of the ratio of the predetermined distance to the measured angle.

Alternatively, the invention relates to the use of the drilling system as mentioned above, and in which:

a holding force of the drill string is defined, said holding force being kept constant, a predetermined angle of rotation of the cutting tool is drilled in the geological formation, a distance corresponding to the forward movement of the cutting tool to drill said predetermined angle is measured, said distance being a distance between the first and second structures of the uncoupling device, and the depth of cut for said geological formation is determined by means of the ratio of the distance measured to the predetermined angle.

Owing those provisions, it is possible to determine the depth of cut using information measured directly at the well bottom. The determination of the depth of cut is therefore very accurate.

In various embodiments of the use of the drilling system according to the invention, use may further be made of any of the following provisions:

the holding force is zero; and the depth of cut allows the strength of the rock at the well bottom to be determined by means of a cutting model of the cutting tool.

The invention relates also to an uncoupling device.

Document FR-2 814 449 describes a device for displacing a load, such as for the handling of stakes or sheet piles.

However, such a device is capable only of counterbalancing the weight of a load, that is to say a force in a vertical direction.

It is an object of the invention to be able to counterbalance forces in any direction.

An uncoupling device according to an embodiment of the invention comprises in a longitudinal direction:

a first structure which is to be fixed to a tube of a drill string, a second structure which is to hold a cutting tool for drilling, said second structure being movable and guided in translation relative to the first structure in the longitudinal direction, a thruster assembly between said first structure and said second structure, said thruster assembly being suitable for exerting a thrusting force on said second structure in order to separate said second structure from said first structure, said thrusting force being substantially constant for every position of the second structure relative to the first structure, the thruster assembly comprising at least one counterbalancing mechanism comprising a resilient member and an output arm, the resilient member producing a resilient force proportional to a compression of the resilient member, the output arm being connected to said resilient member and being capable of pivoting about an output shaft, the uncoupling device being characterised in that the thruster assembly comprises a linking means between the output arm and the second structure for applying the thrusting force to said second structure in said longitudinal direction, said linking means comprising a wheel which is articulated for rotation relative to the output arm, at a distance from said output shaft, and rests against a linking surface which is connected to the second structure and is substantially perpendicular to the longitudinal direction.

By virtue of those provisions, the uncoupling device can be used to uncouple a second structure from a first structure whatever the direction of said structures relative to the vertical or whatever the direction of a force to be uncoupled relative to the vertical.

In various embodiments of the uncoupling device according to the invention, there may further be used any of the following provisions:

the counterbalancing mechanism further comprises:

a movable member which is displaceable according to the compression of the resilient member, an input arm which is articulated for rotation about an input shaft and comprises an end portion in contact with a surface of the movable member, said input arm being inclined at a first angle relative to a direction perpendicular to the longitudinal direction, an input gear which is integral with said input arm, and an output gear which is integral with the output arm and in engagement with said input gear, and the output arm being inclined at a second angle relative to the longitudinal direction, said second angle being twice said first angle;

the movable member is displaceable in translation in the longitudinal direction and is capable of tilting according to a tilt angle relative to said longitudinal direction;

the input and output gears have the shape of a segment in order to reduce the space requirement of the counterbalancing mechanism;

the thruster assembly comprises first and second counterbalancing mechanisms, each counterbalancing mechanism comprising an output shaft, the output shafts being disposed offset relative to one another in the longitudinal direction in order to reduce a radial distance perpendicular to the longitudinal direction between said output shafts and to reduce a radial space requirement perpendicular to the longitudinal direction of the thruster assembly;

the input gears of the first and second counterbalancing mechanisms are in engagement with one another;

the thruster assembly comprises a plurality of modules mounted one behind the other in the longitudinal direction between the first structure and the second structure, each module supplying part of the thrusting force on said second structure so that the sum of said parts of the thrusting force of the modules is equal to the thrusting force of the thruster assembly;

the modules of the plurality are identical, each module supplying an identical part of the thrusting force;

the thruster assembly comprises at least one tension rod which passes through all the modules in the longitudinal direction and is suitable for attaching the modules to the first structure, and each module comprises at least one thrust rod suitable for receiving said part of the thrusting force, the thrust rod of one module being suitable for pushing the thrust rod of the following module or for pushing the second structure with the thrusting force;

each module comprises an expansion means suitable for attaching the module to an outer tube which is integral with the first structure;

a resilient element is housed between each thrust rod and the following thrust rod;

each module comprises an inner tube portion and an outer tube portion surrounding the inner tube portion, and in which:

the outer tube portions are attached one behind the other and to the first structure, the inner tube portions are attached one behind the other and to the second structure, and each module supplies said part of the force the inner tube portion of said module;

the thruster assembly is housed in an annular space which extends radially between an inner tube, which is to carry at least one fluid inside said inner tube, and an outer tube, which is attached to the first structure and surrounds said thruster assembly;

elements of the thruster assembly are assembled integrally with one another by banding, then pinning after banding, in order to be able to withstand mechanical stresses acting upon said assembled elements.

Other features and advantages of the invention will become apparent from the following description of two of its embodiments, which are given by way of non-limiting example, in relation to the accompanying drawings.

In the drawings:

In the various figures, the same reference numerals denote elements which are identical or similar.

FIG. 1 shows a system 1 for boring a drilling well 2, comprising:

Figure 1:
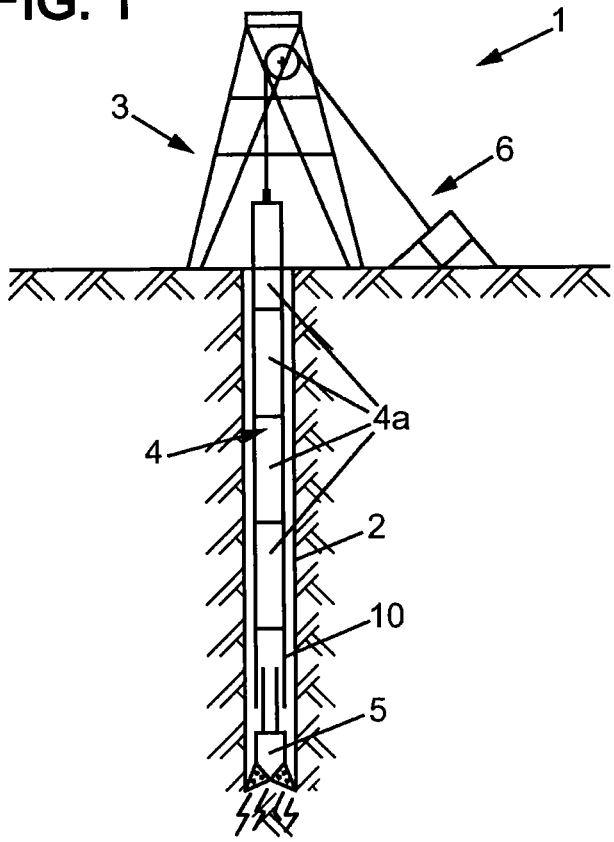
FIG. 1 is a schematic view of a drilling system comprising an uncoupling device according to the invention.

a drilling installation 3, for example at the surface of a terrain or geological formation, a drill string 4 comprising lengths of drilling tubes 4*a* which are attached one behind the other in order to reach a well bottom located at a certain depth from the surface, an uncoupling device 10 mounted at a bottom end of the drill string 4, and a cutting tool or drilling tool or rock drill or cutter 5 mounted at a bottom end of the uncoupling device 10.

The drilling installation 3 comprises, for example, a derrick for handling the tubes, drive means for rotating the drill string 4 and the cutting tool 5, and a holding device 6 suitable for controlling the descent and ascent of the drill string 4 in the drilling well 2 and for controlling a holding force of the weight of the drill string 4 so as to prevent the cutting tool 5 from pressing too hard against the geological formation at the well bottom.

In practice, the weight of the tubes of the drill string 4 can be approximately 100 tonnes. For efficient operation and moderate wear of the cutting tool, the reaction force of the geological formation on the cutting tool 5 must be approximately 20 tonnes, that is to say substantially 200,000 newtons. Consequently, the value of the holding force of the holding device 6 has a very high value and is difficult to control. The vibrations generated by the impacts or shocks of the cutting tool 5 on the geological formation propagate through the tubes from the well bottom to the drilling installation 3. Those vibrations are conventionally used to control the value of the holding force. However, such propagation can take a long time, for example more than 30 seconds. The control effected in the region of the holding device can only be carried out with a considerable delay, which increases the difficulty of controlling the holding force.

Figure 2:
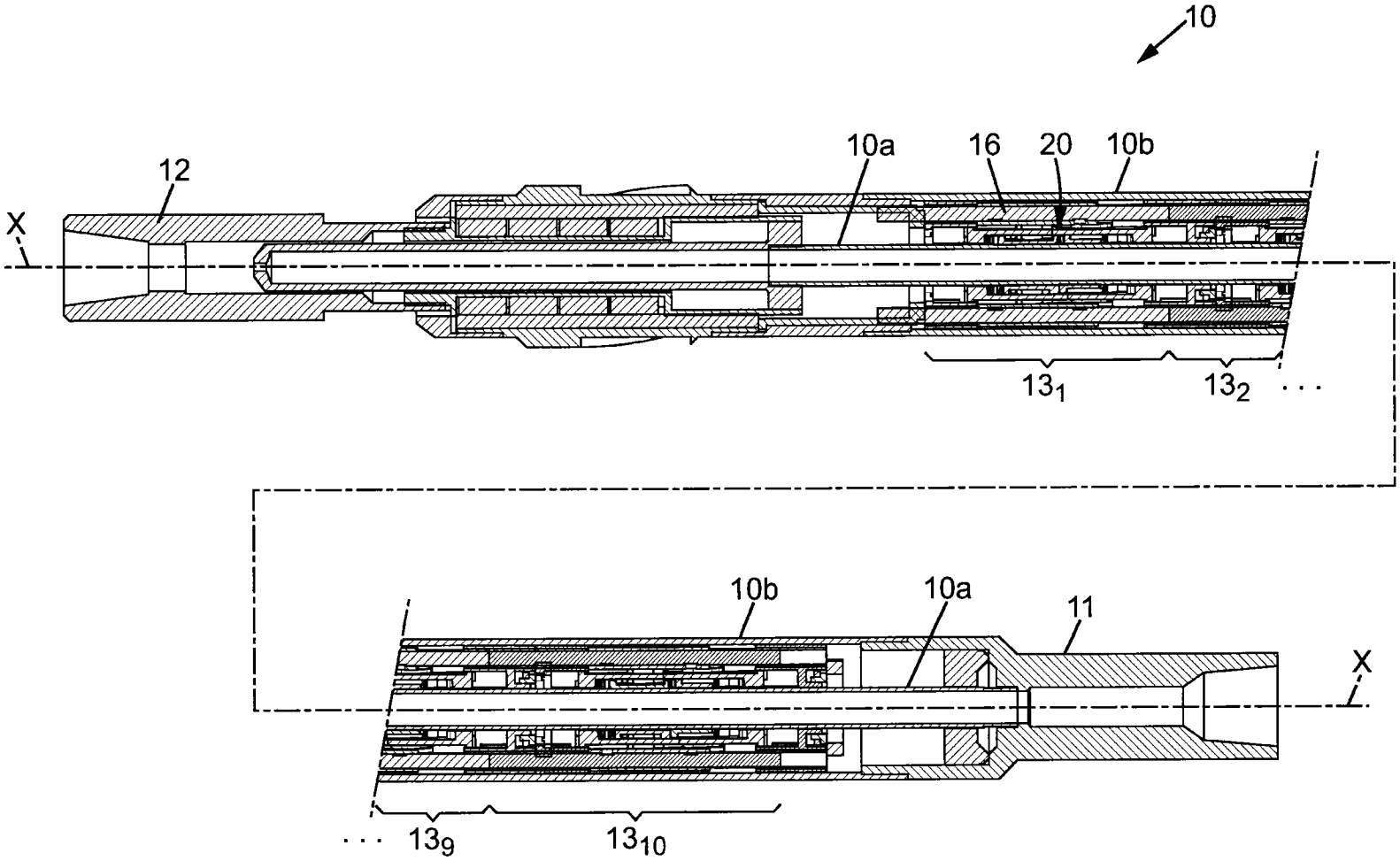
FIG. 2 is a view in longitudinal section of a first embodiment of an uncoupling device.

FIG. 2 shows a first embodiment of an uncoupling device 10 for a drill string. The device extends in a longitudinal direction X and comprises:

a first structure 11, or upstream connection member, which is to be fixed to a tube of a drill string, a second structure 12, or downstream connection member, which is to hold a cutting tool for drilling.

The second structure 12 is movable in translation relative to the first structure 11 in the longitudinal direction X.

The uncoupling device 10 comprises an inner tube 10*a*, which is to carry at least one fluid inside said inner tube, and an outer tube 10*b*, which is attached to the first structure 11 and forms an outer casing for the uncoupling device 10 over substantially its entire length in the longitudinal direction X. The inner tube 10*a* and/or the outer tube 10*b* can optionally be produced by assembly of sections in order to facilitate mounting of the uncoupling device 10.

For example, the outer tube 10*b* can have an average diameter of from 200 mm to 600 mm. For example, the inner tube 10*a* can have an average diameter of from 40 mm to 200 mm.

The uncoupling device 10 comprises a thruster assembly comprising modules 13, for example ten modules 13, which are identified separately by the reference numerals $\mathbf{13}_1$ to $\mathbf{13}_{10}$, the modules being mounted in series one behind the other in the longitudinal direction X between the first structure 11 and the second structure 12 inside the outer tube 10*b*. The modules 13 are all identical in the embodiment of FIG. 2, but it is possible to assemble different modules having different features.

Each module 13 comprises:

- a support structure 16, the support structures 16 of the series or group of modules 13 being attached to one another by means of tension rods 14, which pass through them and connect them to the first structure 11,
- two thrust rods 15 which pass through them in the longitudinal direction X and which are to transmit a displacement to the second structure 12, and
- counterbalancing mechanisms 20 suitable for exerting a thrust in the longitudinal direction X on the thrust rods 15 in order to effect the displacement thereof.

The thrust of each counterbalancing mechanism 20 is substantially constant for every position of the thrust rods 15 relative to the support structure 16, that is to say for every position of the second structure 12 relative to the first structure 11.

The displacement stroke of the thrust rods 15 is, for example, from 50 mm to 200 mm, and for the embodiment shown it is, for example, 90 mm.

The thrust rods 15 of the last module $\mathbf{13}_1$, close to the second structure 12 or the cutting tool 5, act upon or push the second structure 12, and the thrust rods 15 of the other modules $\mathbf{13}_2$ to $\mathbf{13}_{10}$ act upon or push the corresponding thrust rods 15 of the following module $\mathbf{13}_1$ to $\mathbf{13}_9$.

The modules 13 can be positioned angularly relative to one another by centring pins.

Resilient elements (not shown) can also be interposed between the thrust rods 15 of successive adjacent modules in order to avoid any phenomenon of static indeterminancy of the links between the modules and any blocking of the uncoupling device 10 during its operation.

The modules 13 each transmit a thrust to the next module and act in parallel, the second structure 12 then being subject to a thrusting force which is the sum of the thrusts of all the counterbalancing mechanisms 20 of all the modules 13 of the uncoupling device 10.

In the present embodiment, the thruster assembly comprises ten modules 13 each comprising four counterbalancing mechanisms. The modules 13 are substantially identical and produce the same thrust. The second structure 12 is subject to a thrusting force which is substantially equal to ten times the thrust of one of the modules 13 of the uncoupling device or forty times the thrust of one of the counterbalancing mechanisms.

For example, if the second structure 12 has to receive an overall thrusting force of 200,000 newtons, each module 13 produces 20,000 newtons and each counterbalancing mechanism produces 5000 newtons.

Figure 3:
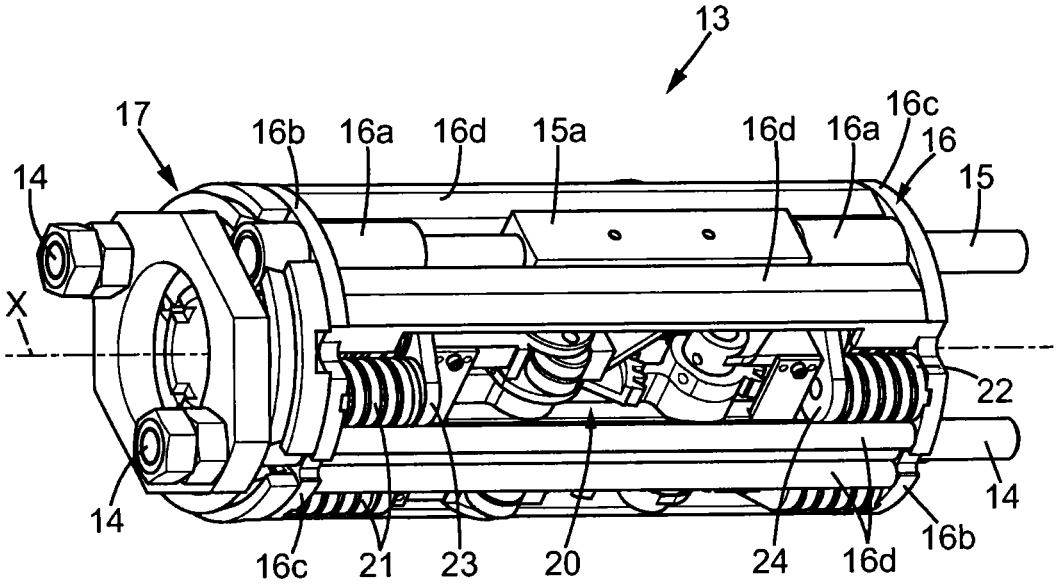
FIG. 3 is a perspective view of a module of the uncoupling device of FIG. 2.
Figure 4:
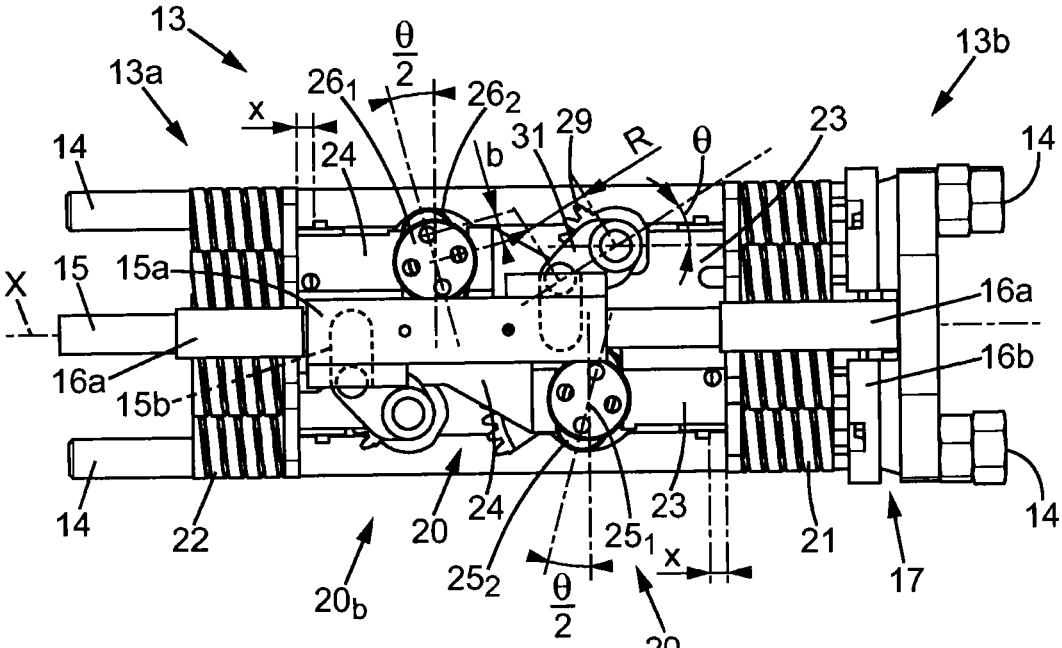
FIG. 4 is a side view of the module of FIG. 3.
Figure 5:
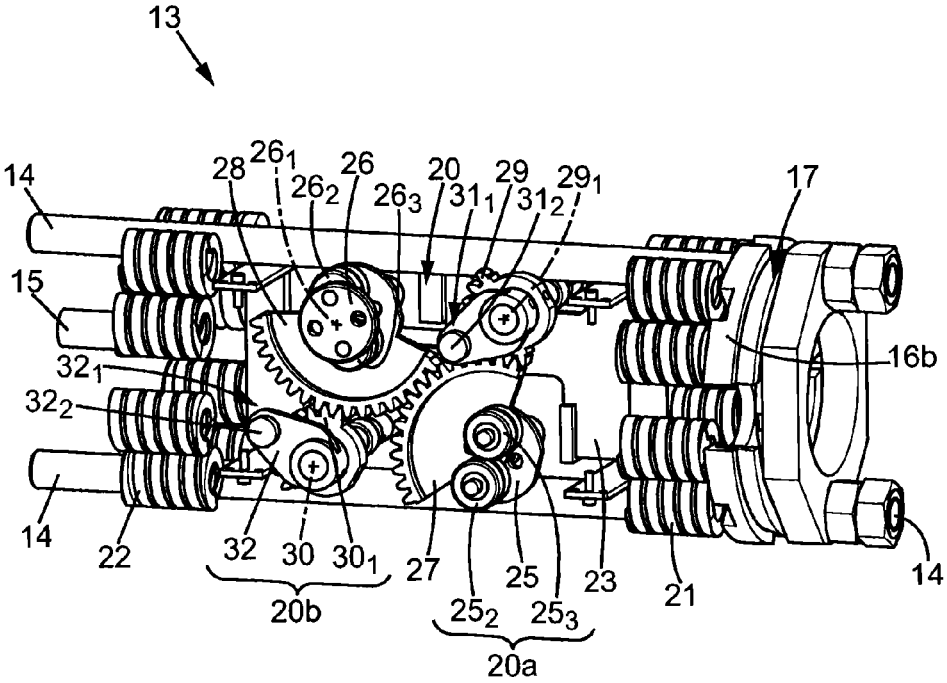
FIG. 5 is another perspective view of the module of FIG. 3.

FIGS. 3, 4 and 5 show detailed views of a module 13 of the uncoupling device 10. The module 13 comprises:

- a support structure 16 connected to the first structure 11 by tension rods 14,
- two thrust rods 15 extending in the longitudinal direction X, and
- counterbalancing mechanisms 20 for exerting a thrust in the longitudinal direction X on the thrust rods 15.

Each module 13 is housed in a cylindrical annular space which extends radially between the inner tube 10*a* and the outer tube 10*b* of the uncoupling device 10.

Each module 13 comprises a radial expansion means 17 which is linked to the support structure 16 and is suitable for attaching the module 13 to the inside of the outer tube 10*b*. A module 13 is accordingly positioned in the outer tube 10*b*, attached to the outer tube by actuation of its radial expansion means 17, before the following module 13 is positioned in the outer tube 10*b*. The modules 13 are accordingly fixed in the outer tube 10*b* and each transmit their forces and stresses to that tube, so that phenomena of static indeterminancy are reduced and the outer tube 10*b* is able to deform and especially bend during operation in the drilling well without influencing the operation of each module 13 of the uncoupling device.

The support structure 16 is in the form of a rigid cage comprising a first support plate 16*b* at a first longitudinal end of the module, a second support plate 16*c* at a second longitudinal end of the module, each support plate being substantially in a plane perpendicular to the longitudinal direction, and longitudinal cross-members 16*d* connecting the first support plate 16*b* to the second support plate 16*c*. The support structure 16 also comprises guide bearings 16*a* mounted on the first and second support plates 16*b*, 16*c* for guiding the thrust rods 15 in translation relative to the support structure 16 over the entire displacement stroke.

Slides 15*a* are attached in a middle portion of each thrust rod 15, for receiving the thrust of the counterbalancing mechanism 20.

Each thrust rod 15 is therefore capable of displacement in translation in the support structure 16 between a first and second bearing 16*a*. The slide 15*a* can further come into abutment between the bearings in order to limit the displacement of the thrust rod 15 in the support structure 16.

The counterbalancing mechanism 20 converts a compression x of a resilient element into a rotation through a first angle $\theta_1$ of an input arm, then into a rotation through a second angle $\theta_2$ of an output arm. The first angle $\theta_1$ has a value of half the value of the second angle $\theta_2$:$\theta_1=\theta_2/2=\theta/2$.

Explanations of the principle of operation of a similar counterbalancing mechanism can be found in patent publication FR-2 627 718, then patent publication FR-2 814 449. However, the counterbalancing mechanism 20 of the uncoupling device 10 of the present invention is different owing to the reduced space requirement of the module 13 and its generally cylindrical shape. Moreover, the present uncoupling device 10 comprises a means for guiding the second structure relative to the first structure, so that it is able to balance a force in any direction and not only the weight of a load in the vertical direction.

FIGS. 4 and 5 show a module 13 in which elements have been removed in order better to show a counterbalancing assembly comprising two interconnected counterbalancing mechanisms 20*a*, 20*b* as described below.

The counterbalancing assembly comprises:

a first resilient member 21 at a first end 13*a* of the module 13, comprising, for example, four metal helical springs which rest, in the longitudinal direction X, on one side on the first support plate 16*b* and on the other side on a first movable member 23, a second resilient member 22 at a second end 13*b* of the module 13, also comprising, for example, four metal helical springs which rest, in the longitudinal direction X, on one side on the second support plate 16*c* and on the other side on a second movable member 24.

The first and second resilient members 21, 22 are housed inside the support structure 16, oriented towards one another in the direction of the inside of the module, that is to say of a central portion or zone of said module 13. They are mounted with a bias and act upon each movable member 23, 24 so that the latter tend to move towards one another. Accordingly, the movable members 23, 24 each have surfaces facing one another.

The first counterbalancing mechanism 20*a* comprises:

a first input arm 25 which is articulated for rotation about a middle input shaft $\mathbf{25}_1$ relative to the support structure 16 of the module 13 and which comprises at each of its ends, on either side of the input shaft $\mathbf{25}_1$, a wheel $\mathbf{25}_2$, $\mathbf{25}_3$ which is freely rotatable relative to said first input arm 25, the first wheel $\mathbf{25}_2$ coming into contact with the surface of the second movable member 24, the second wheel $\mathbf{25}_3$ coming into contact with the surface of the first movable member 23, a first input gear 27 which is integral with said first input arm 25, a first output gear 29 which is articulated for rotation about an output shaft $\mathbf{29}_1$ relative to the support structure 16 of the module 13, in engagement with the first input gear 27 by suitable toothing of said first input and output gears 27, 29, a first output arm 31 which extends between the output shaft $\mathbf{29}_1$ and an end $\mathbf{31}_1$, integral with said first output gear 29, and comprising at its end $\mathbf{31}_1$ a wheel $\mathbf{31}_2$ which is mounted to be freely rotatable relative to said output arm 31, said wheel $\mathbf{31}_2$ coming into contact with a linking surface substantially perpendicular to the longitudinal direction of the slide 15*a*.

The first input arm 25 is inclined at a first angle $\theta_1=\theta/2$ relative to a direction substantially perpendicular to the longitudinal direction X.

The first output arm 31 is inclined at a second angle $\theta_2=\theta$ relative to the longitudinal direction.

The second counterbalancing mechanism 20*b* is similar to the first counterbalancing mechanism 20*a*. It comprises:

a second input arm 26 which is articulated for rotation about a middle input shaft $\mathbf{26}_1$ relative to the support structure 16 of the module 13 and which comprises at each of its ends, on either side of the input shaft $\mathbf{26}_1$, a wheel $\mathbf{26}_2$, $\mathbf{26}_3$ which is freely rotatable relative to said second input arm 26, the first wheel $\mathbf{26}_2$ coming into contact with the surface of the second movable member 24, the second wheel $\mathbf{26}_3$ coming into contact with the surface of the first movable member 23, a second input gear 28 which is integral with said second input arm 26, a second output gear 30 which is articulated for rotation about an output shaft $\mathbf{30}_1$ relative to the support structure 16 of the module 13, in engagement with the second input gear 28 by suitable toothing of said second input and output gears 28, 30, a second output arm 32 which extends between the output shaft $\mathbf{30}_1$ and an end $\mathbf{32}_1$, integral with said second output gear 30, and comprising at its end $\mathbf{32}_1$ a wheel $\mathbf{32}_2$ which is mounted to be freely rotatable relative to said output arm 32, said wheel $\mathbf{31}_2$ coming into contact with a linking surface substantially perpendicular to the longitudinal direction of the slide 15*a*.

The second input arm 26 is inclined at a third angle $\theta_3=\theta/2$ relative to a direction substantially perpendicular to the longitudinal direction, the third angle therefore being opposite the first angle.

The second output arm 32 is inclined at a fourth angle $\theta_4=-\theta$ relative to the longitudinal direction, the fourth angle therefore being opposite the second angle.

Furthermore, the first input gear 27 of the first mechanism 20*a* is in engagement with the second input gear 28 of the second mechanism 20*b*, so that the first and second input gears 27, 28 pivot in opposite directions. The first and second counterbalancing mechanisms are therefore substantially symmetrical relative to the longitudinal direction. The first and second output arms 32, 32 also pivot indifferent directions. However, because those output arms are on either side of the slide 15*a* of the thruster 15, they both push the thruster 15 in the same direction, thus adding together their respective thrusts.

Owing to the geometry of each counterbalancing mechanism 20 (the angles of the arms), the counterbalancing mechanisms transmit a constant thrust to the slide 15*a* whatever the position of the slide 15*a* between the guide bearings 16*a*, said thrust being in the longitudinal direction X.

Figure 6:
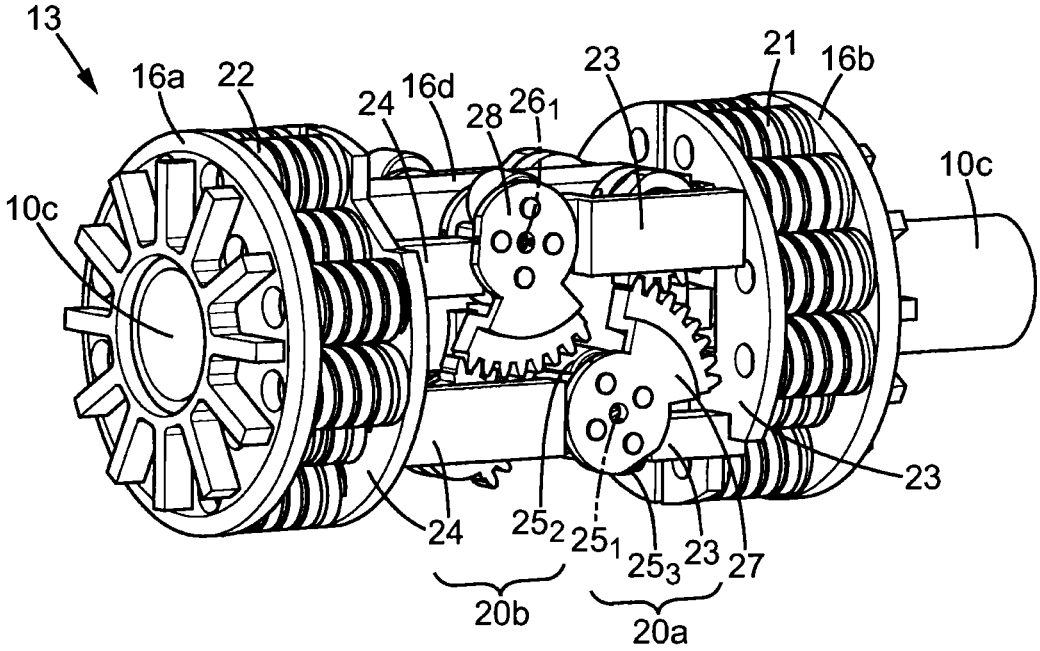
FIG. 6 is a perspective view of a module of a second embodiment of an uncoupling device.
Figure 7:
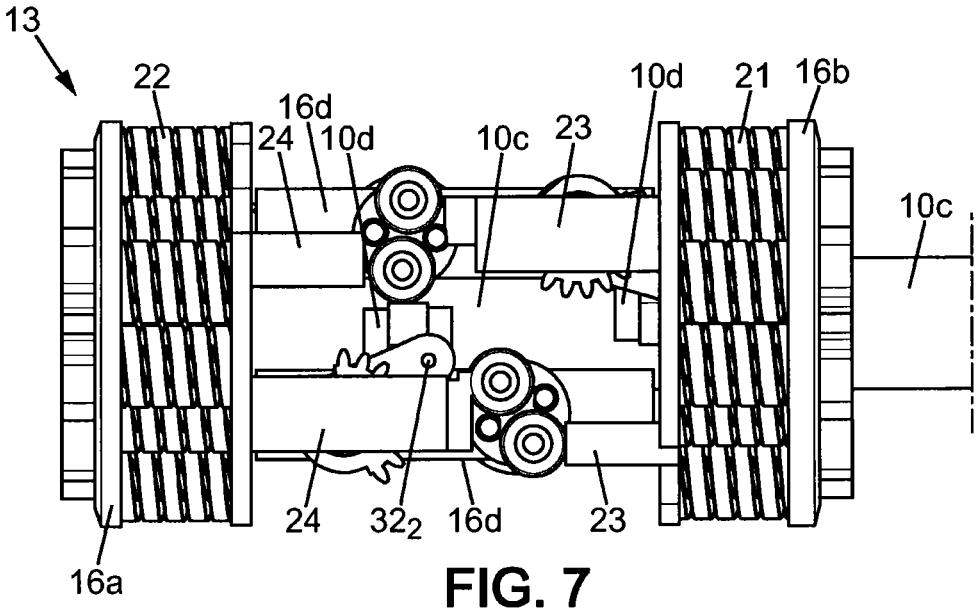
FIG. 7 is a side view of the module of FIG. 6, with elements removed for the purpose of visibility.
Figure 8:
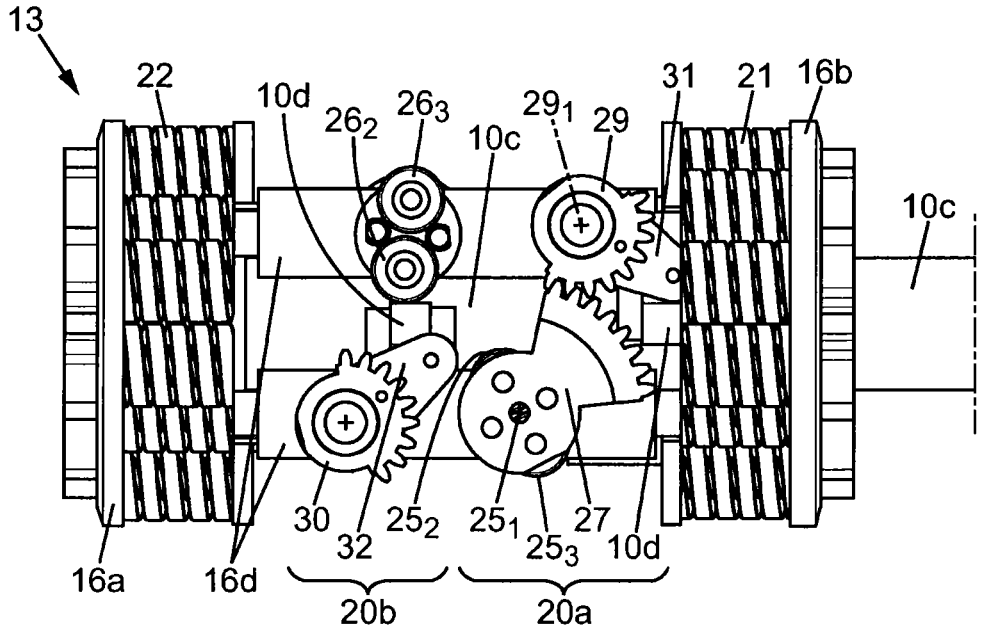
FIG. 8 is another side view of the module of FIG. 6, with other elements removed for the purpose of visibility.

FIGS. 6 to 8 show a second embodiment of an uncoupling device 10. In comparison with the first embodiment, the second embodiment is simplified: It does not include either a tension rod or a thrust rod or a radial expansion means.

In this second embodiment, each module 13 comprises an outer tube section (not shown) which serves both to give support to the module 13, as do the longitudinal cross-members 16*d* of the support structure of the first embodiment, and to transmit to the first structure 11 a reaction force to the thrusting force of the modules 13, as do the tension rods 14 of the first embodiment.

Each module 13 also comprises an inner tube section 10*c*, which is here suitable for transmitting the thrusting force of the modules 13, as do the thrust rods 15 of the first embodiment.

The outer tube of this embodiment is therefore not made in one piece, and the modules 13 are therefore not mounted one behind the other inside the outer tube. Because the outer tube section forms part of the module 13, the modules 13 are simply mounted one behind the other, each outer tube section being suitable for attachment to the following tube section or to the first structure.

The inner tube 10*a* of this second embodiment is also produced by assembly of the inner tube sections 10*c* of each module 13. Each inner tube section 13*c* also comprises projections 10*d* having linking surfaces so that the wheels $\mathbf{31}_2$, $\mathbf{32}_2$ of the output arms 31, 32 are able to push said inner tube section 10*c* in the longitudinal direction.

Owing to those provisions, the modules 13 are simplified and their assembly is also simplified.

The elements removed from the first embodiment free space for making the remaining elements larger with more material. They are therefore stronger. Furthermore, this allows more metal springs for forming the resilient members 21, 22 to be placed in each module 13. Consequently, the module 13 of the second embodiment is more efficient, that is to say it is capable of supplying a greater thrusting force for the same space requirement.

Furthermore, in the second embodiment, the first input gear 27 of the first counterbalancing mechanism 20*a* is no longer in engagement with the second input gear 28 of the second counterbalancing mechanism 20*b* (FIG. 6). The counterbalancing mechanisms 20 of this embodiment are more independent of one another.

The first and second movable members 23, 24 are able to be displaced not only in the longitudinal direction X but also according to tilt angles relative to the longitudinal direction. The angular tilts are absorbed by the resilience of the resilient members 21, 22 and do not interfere with the rotation of the first and second input gears 27, 28 or with the first and second output gears 29, 30, said gears being articulated for rotation relative to a longitudinal cross-member 16*d* of the support structure.

The risks of static indeterminancy and of blocking of the uncoupling device are thus reduced.

Furthermore, the input gears 27, 28 can be formed of a segment having a narrower angle. That angle is, for example, greater than 90° and close to 180° for the input gears 27, 28 of the first embodiment (FIG. 5), whereas for the input gears 27, 28 of the second embodiment (FIG. 6) it is, for example, less than 45°.

The gears therefore occupy less space in the module 13.

Owing to those modifications, it is possible to place more metal springs for producing the resilient members 21, 22. The module 13 is then even more efficient. Those modifications can likewise be adapted to the first embodiment of the invention.

For all the embodiments of the invention, the uncoupling device can comprise:

- a displacement sensor for determining the position of the second structure 12 relative to the first structure 11, and
- a transmission means for transmitting the position to the holding device 6 in order to control the holding force of the drill string.

Owing to that position information, it is possible better to control the holding force required of the holding device 6, and especially to request that the holding force be reduced or increased as a function of said position.

The uncoupling device 10 of such a controlled system is then in most cases in a state in which the second structure 12 is not in abutment on the first structure 11. In that state, the second structure 12 receives a predetermined thrusting force adapted for good operation of the cutting tool 5. Reciprocally, the cutting tool 5 is protected from any reaction force greater than said predetermined thrusting force.

The uncoupling device can be used to determine precisely the depth of cut DOC.

Conventionally, the depth of cut DOC is determined at the well head, by measuring the forward movement of the drill string 4 in the well and the rotation of the drill string.

However, the drill string is not completely rigid and it bends, becomes compressed and twists according to its axis. Consequently, the true rotation and forward movement of the tool in the geological formation are not known precisely. Corrections can be made by calculation, but the values in the region of the tool 5 at the well bottom remain unknown, so that the depth of cut values calculated are inaccurate.

The uncoupling device according to the invention now enables the depth of cut DOC to be obtained directly. The second structure 12 of the uncoupling device is in fact substantially fixed relative to the geological formation, and the displacement of the first structure relative to the second structure corresponds to the forward movement of the cutting tool 5 in the geological formation.

Therefore, the depth of cut DOC can be determined by carrying out the following steps:

- a holding force of the drill string is determined, said holding force being kept constant,
- a predetermined distance of the geological formation is drilled, said distance being measured between the first and second structures of the uncoupling device 10, and being less than a stroke of the uncoupling device 10,
- an angle corresponding to the angular rotation of the cutting tool 5 to drill said predetermined distance is measured, and
- the depth of cut DOC for said geological formation is determined by means of the ratio of the predetermined distance to the angle measured.

Alternatively, the depth of cut can be determined by carrying out the following steps:

- a holding force of the drill string is defined, said holding force being kept constant,
- a predetermined angle of rotation of the cutting tool 5 is drilled in the geological formation,
- a distance corresponding to the forward movement of the cutting tool 5 to drill said predetermined angle is measured, said distance being a distance between the first and second structures of the uncoupling device 10, and
- the depth of cut DOC for said geological formation is determined by means of the ratio of the measured distance to the predetermined angle.

The holding force imposed may be zero. In that case, the brake of the holding device 6 is released completely and all the weight of the drill string 4 is applied to the assembly comprising the uncoupling device 10 and the cutting tool 5.

Finally, such a use of the uncoupling device 10 is very advantageous for determining physical parameters of the geological formation and, for example, the confined compressive strength CCS of the rock.

Such confined compressive strength can be calculated by means of a cutting model of the cutting tool 5.

A cutting model is described in the document: "A Phenomenological Model for the Drilling Action of Drag Bits", E. Detournay, P. Defourny, International Journal of Rock Mechanics and Mining Sciences & Geomechanics Abstracts, Volume 29, No. 1, January 1992, pages 13-23.

In that document, equation 22 connects the torque T, the weight W and the depth of cut δ (here DOC):

$$\frac{2T}{a} = (1 - \mu\gamma\zeta)\epsilon a\delta + \mu\gamma W$$

where

- T is the torque of the drill string 4,
- a is the radius of the cutting tool 5,
- μ is a coefficient of friction of the cutting tool on the geological formation,
- γ is a number which models the influence of the orientation and of the distribution of the contact forces between the cutting tool 5 and the geological formation,
- ζ is a number characterising the inclination of the cutting force on a cutting element of the cutting tool 5,
- ϵ is the specific intrinsic energy, that is to say the energy necessary to cut a unit volume of rock of the geological formation ($J/m^3$ or MPa),
- δ (or DOC) is the depth of cut, and
- W is the weight applied to the cutting tool 5.

The specific energy c corresponds to the confined compressive strength CCS of the rock.

The torque T and the weight W are known.

Precise knowledge of the depth of cut δ (or DOC) allows the specific intrinsic energy ϵ, that is to say the confined compressive strength CCS of the rock, to be determined precisely using the above equation.

The invention claimed is:

1. An uncoupling device for a drill string, comprising in a longitudinal direction:

a first structure which is to be fixed to a tube of a drill string;

a second structure which is to hold a cutting tool for drilling, said second structure being movable in translation relative to the first structure in the longitudinal direction;

a thruster assembly between said first structure and said second structure, said thruster assembly being configured to exert a thrusting force on said second structure to separate said second structure from said first structure, in which the second structure is guided in translation relative to the first structure in the longitudinal direction, and the thruster assembly comprises:

a counterbalancing mechanism comprising a resilient member and an output arm, the resilient member producing a resilient force proportional to a compression of the resilient member, the output arm being connected to said resilient member and being capable of pivoting about an output shaft; and a linking means between said output arm and said second structure for applying said thrusting force to said second structure in said longitudinal direction, said linking means comprising a wheel which is articulated for rotation relative to the output arm, at a distance from said output shaft, and rests against a linking surface which is connected to the second structure and is substantially perpendicular to the longitudinal direction.

2. A device according to claim 1, in which the counterbalancing mechanism further comprises:

a movable member which is displaceable according to the compression of the resilient member;

an input arm which is articulated for rotation about an input shaft and comprises an end portion in contact with a surface of the movable member, said input arm being inclined at a first angle relative to a direction perpendicular to the longitudinal direction;

an input gear which is integral with said input arm; and an output gear which is integral with the output arm and in engagement with said input gear, and the output arm being inclined at a second angle relative to the longitudinal direction, said second angle being twice said first angle.

3. A device according to claim 2, in which the movable member is displaceable in translation in the longitudinal direction and is capable of tilting according to a tilt angle relative to said longitudinal direction.

4. A device according to claim 2, in which the input and output gears have a shape of a segment to reduce a space requirement of the counterbalancing mechanism.

5. A device according to claim 1, in which the thruster assembly comprises first and second counterbalancing mechanisms, each counterbalancing mechanism comprising an output shaft, the output shafts being disposed offset relative to one another in the longitudinal direction to reduce a radial distance perpendicular to the longitudinal direction between said output shafts and to reduce a radial space requirement perpendicular to the longitudinal direction of the thruster assembly.

6. A device according to claim 5, in which input gears of the first and second counterbalancing mechanisms are in engagement with one another.

7. A device according to claim 1, in which the thruster assembly comprises a plurality of modules mounted one behind the other in the longitudinal direction between the first structure and the second structure, each module supplying part of the thrusting force on said second structure so that the sum of said parts of the thrusting force of the modules is equal to the thrusting force of the thruster assembly.

8. A device according to claim 7, in which the modules of the plurality are identical, each module supplying an identical part of the thrusting force.

9. A device according to claim 7, in which the thruster assembly comprises at least one tension rod which passes through all the modules in the longitudinal direction and is configured to attach the modules to the first structure, and each module comprises at least one thrust rod configured to receive said part of the thrusting force, the thrust rod of one module being configured to push the thrust rod of the following module or for pushing the second structure with the thrusting force.

10. A device according to claim 9, in which each module comprises an expansion means configured to attach the module to an outer tube which is integral with the first structure.

11. A device according to claim 9, in which a resilient element is housed between each thrust rod and the following thrust rod.

12. A device according to claim 7, in which each module comprises an inner tube portion and an outer tube portion surrounding the inner tube portion, and in which:

the outer tube portions are attached one behind the other and to the first structure;

the inner tube portions are attached one behind the other and to the second structure; and each module supplies said part of the force to the inner tube portion of said module.

13. A device according to claim 1, in which the thruster assembly is housed in an annular space which extends radially between an inner tube, which is to carry at least one fluid inside said inner tube, and an outer tube which is attached to the first structure and surrounds said thruster assembly.

14. A device according to claim 1, in which elements of the thruster assembly are assembled integrally with one another by banding, then pinning after banding, to be able to withstand mechanical stresses acting upon said assembled elements.

15. A drilling system comprising:

an uncoupling device according to claim 1; and a drill string comprising at least one tube, said drill string being connected to the first structure of the uncoupling device;

a cutting tool which is to drill a geological formation, the cutting tool being connected to the second structure of the uncoupling device; and a holding device for holding the drill string at a head of the drilling well, which holding device is configured to control descent and ascent of the drill string in the drilling well.

16. A system according to claim 15, in which the uncoupling device comprises at least one displacement sensor for determining a position of the second structure relative to the first structure, and the system further comprises a transmission means for transmitting said position to the holding device for controlling a holding force of the drill string.

* * * * *